US010272697B2

(12) United States Patent
Van Hout et al.

(10) Patent No.: US 10,272,697 B2
(45) Date of Patent: Apr. 30, 2019

(54) PRINT HEAD CARRIAGE ASSEMBLY

(71) Applicant: Océ Holding B.V., Venlo (NL)

(72) Inventors: Richard F. E. Van Hout, Venlo (NL); Johan Schutten, Venlo (NL); Elisabeth H. G. Beckers-Vaasen, Venlo (NL); John B. L. De Kock, Venlo (NL); Marcellus W. P. Van De Put, Venlo (NL); Mark M. J. Gosens, Venlo (NL)

(73) Assignee: OCÉ HOLDING B.V., Venlo (NL)

( * ) Notice: Subject to any disclaimer, the term of this patent is extended or adjusted under 35 U.S.C. 154(b) by 0 days.

(21) Appl. No.: 15/906,893

(22) Filed: Feb. 27, 2018

(65) Prior Publication Data

US 2018/0250964 A1 Sep. 6, 2018

(30) Foreign Application Priority Data

Mar. 6, 2017 (EP) ..... 17159430

(51) Int. Cl.
*B41J 11/00* (2006.01)

(52) U.S. Cl.
CPC ..... *B41J 11/002* (2013.01)

(58) Field of Classification Search
CPC ..... B41J 11/002
See application file for complete search history.

(56) References Cited

U.S. PATENT DOCUMENTS

2003/0189609 A1* 10/2003 Ishikawa ..... B41J 2/04531 347/11
2006/0007290 A1* 1/2006 Oshima ..... B41J 3/543 347/102

(Continued)

FOREIGN PATENT DOCUMENTS

EP 2 734 370 A2 5/2014
WO WO 2013/028995 A2 2/2013

OTHER PUBLICATIONS

Search Report for European Patent Application No. 17159430, completed on Aug. 28, 2017.

*Primary Examiner* — Julian D Huffman
(74) *Attorney, Agent, or Firm* — Birch, Stewart, Kolasch & Birch, LLP

(57) ABSTRACT

In a printer, a print head carriage assembly includes a carriage arranged to move in a main scanning direction relative to a recording medium; a plurality of print heads mounted on the carriage and arranged to apply a curable marking material onto the recording medium; and a number of curing devices mounted on the carriage and disposed in positions relative to the print heads such that each print head is associated with at least one of the curing devices. The at least one of the curing devices is disposed to follow its associated print head in a distance in the main scanning direction so as to cure the ink that has been applied with that print head. The print heads are arranged in at least two rows which extend in the main scanning direction and are staggered in a sub-scanning direction normal to the main scanning direction, and the print heads are grouped such that each print head in each row has, in each other row, a counterpart print head which belongs to the same group. The curing devices include at least one separate curing device for each row and each separate curing device is associated with print heads of at least two groups. The distances between the curing devices and the associated print heads are different from group to group but are the same for all rows.

6 Claims, 1 Drawing Sheet

(56) References Cited

U.S. PATENT DOCUMENTS

Figure 1:
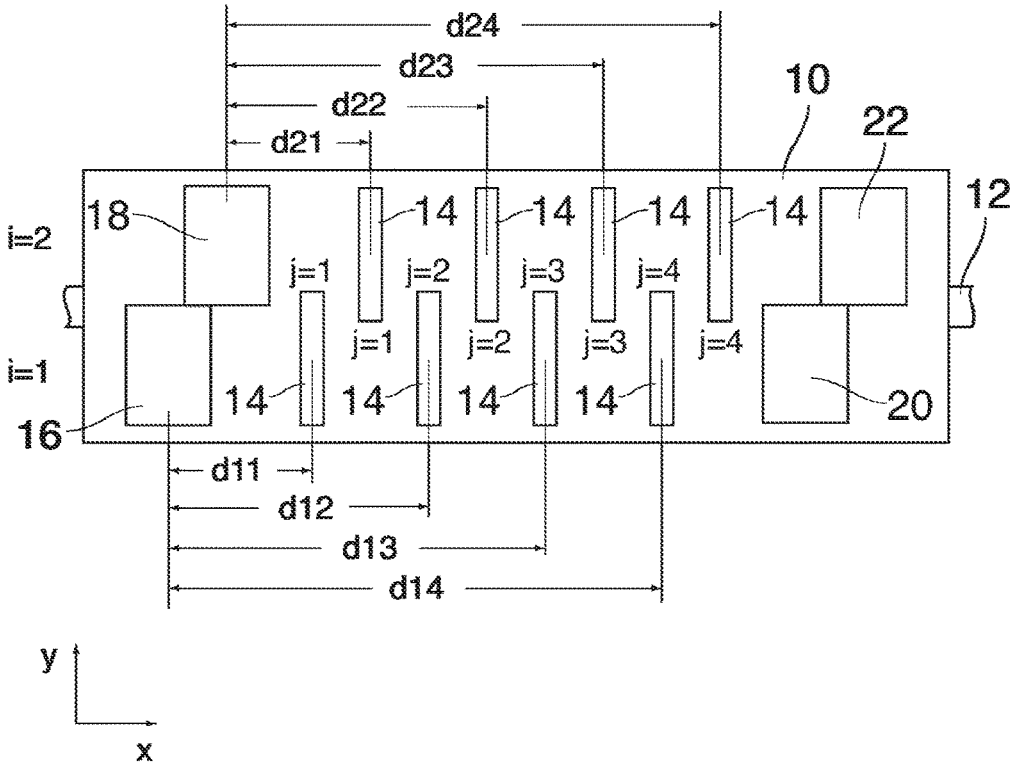

| | | | | |
|---|---|---|---|---|
| 2012/0249651 | A1* | 10/2012 | Akiyama | B41J 11/002 347/16 |
| 2013/0050368 | A1* | 2/2013 | Lahut | B41J 2/155 347/102 |
| 2013/0335469 | A1* | 12/2013 | Saita | B41J 2/2103 347/12 |
| 2014/0354743 | A1* | 12/2014 | Tsuchiya | B41J 11/002 347/102 |
| 2015/0124017 | A1* | 5/2015 | Aoyama | B41J 11/002 347/16 |
| 2015/0231892 | A1* | 8/2015 | Mochizuki | B41J 2/15 347/12 |
| 2016/0052299 | A1 | 2/2016 | Latorre | |

* cited by examiner

PRINT HEAD CARRIAGE ASSEMBLY

The invention relates to a print head carriage assembly in a printer, comprising:

a carriage arranged to move in a main scanning direction relative to a recording medium;

a plurality of print heads mounted on the carriage and arranged to apply a curable marking material onto the recording medium; and a number of curing devices mounted on the carriage and disposed in positions relative to the print heads such that each print head is associated with at least one of the curing devices, said at least one of the curing devices being disposed to follow its associated print head in a distance in the main scanning direction so as to cure the ink that has been applied with that print head, the print heads being arranged in at least two rows which extend in the main scanning direction and are staggered in a sub-scanning direction normal to the main scanning direction, and the print heads being grouped such that each print head in each row has, in each other row, a counterpart print head which belongs to the same group.

More particularly, the invention relates to a print head carriage assembly for an ink-jet printer which operates with a radiation-curable ink, such as a UV-curable ink.

US 2016/052299 A1 discloses a print head carriage assembly of this type wherein the curing devices are formed by LEDs which emit ultraviolet light. The different groups of print heads are provided for printing with different colors. For example, for groups may be provided for printing with the basic colors C, M, Y and K.

In the known carriage assembly, each print head is associated with a separate curing device so that the total number of curing devices on the carriage is the same as the total number of print heads. This has the advantage that the distance in the main scanning direction between the print head and its associated curing device can be selected independently for each print head, so that the distance in the main scanning direction between the print head and the curing device can be the same for all print heads. When the print head carriage moves with a fixed speed in the main scanning direction, the distance between the print head and the curing device determines the so-called dwell time, in which a droplet of liquid ink which has been applied onto the surface of the recording medium can spread until the ink is cured by the curing device. Uniform dwell times avoid a visible artifact, a so-called banding phenomenon, which occurs as a result of gloss differences of the printed image. Such gloss differences would be likely to occur, when the dwell-times are different for swathes of the image which have been printed with different print heads.

The known carriage design can avoid this banding phenomenon but requires a large number of curing devices which makes the carriage assembly expensive and bulky.

It is an object of the invention to provide a print head carriage assembly which has a cheaper and more compact design and is nevertheless capable of producing printed images with high quality.

In order to achieve this object, according to the invention, the curing devices comprise at least one separate curing device for each row, each separate curing device is associated with print heads of at least two groups, and the distances between the curing devices and the associated print heads are different from group to group but are the same for all rows. It has surprisingly been found that a same dwell time for each print head in a group prevents the above-mentioned gloss-difference artifacts, while dwell times for print heads in different groups may remain different.

Mathematically, the latter feature can be expressed as follows: If the distances between the print head and its associated curing device are designated as $d_{ij}$ for one print head and as $d_{rs}$ for another print head, wherein the first index i and r, respectively, designates the row to which the print head belongs and the second index j and s, respectively, designates the group to which the print head belongs, then i=r and j=s implies $d_{ij}=d_{rs}$, and i=r and j≠s implies $d_{ij}\neq d_{rs}$.

With the features according to the invention, cost savings and a compact design of the carriage can be achieved because one and the same curing device can be used for a plurality of print heads, namely for print heads which belong to the same row but to different groups. Nevertheless, it is assured that, for each group of print heads and correspondingly for each ink color in case of an ink-jet print head, the dwell-times are the same for all print heads of the group, regardless of the row in which the print heads are positioned.

More specific optional features of the invention are indicated in the dependent claims.

In one embodiment, two curing devices are provided for each row, the curing devices being disposed at opposite ends of the row, so that the ink can always be cured with one of the curing devices when the print head moves back and forth in the main scanning direction. In that case, both curing devices are positioned such that the above-mentioned distance criterion is fulfilled individually for each of the two curing per row.

Figure 2:
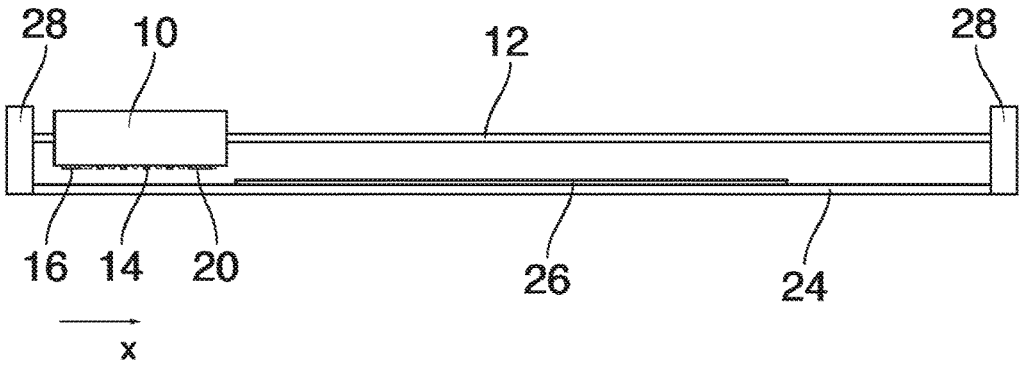

An embodiment example will now be described in conjunction with the drawings, wherein:

FIG. 1 is a schematic top plan view of a print head carriage assembly according to the invention; and FIG. 2 is a front view of an ink-jet printer having the print head carriage assembly shown in FIG. 1.

The print head carriage assembly shown in FIG. 1 comprises a carriage 10 which is driven to move reciprocatingly along a guide rail 12 which extends in a main scanning direction x.

In this example, the carriage 10 has eight ink-jet print heads 14 which are arranged in two rows designated by a row index i (i=1, 2). The rows extend in the main scanning direction x and are staggered in a sub-scanning y normal to the main scanning direction x. In example shown, the print heads 14 of the second row (i=2) are offset from the print heads 14 of the first row (i=1) such that the position of a print head in the main scanning direction x corresponds to the center of the gap between the two adjacent print heads in the other row. Further, in this example, the print heads are disposed with equal spacings.

The carriage 10 further comprises four curing devices 16, 18, 20, 22 which may be constituted by UV-emitting LEDs, for example. The curing devices 16 and 20 are provided at opposite ends of the first row of print heads 14, and the curing devices 18 and 22 are provided at the opposite ends of the second row.

As it is shown in FIG. 2, the print head 14 and the curing devices 16-22 are mounted on a bottom side of the carriage 10 facing a print surface 24 on which a recording medium 26 can be advanced in the sub-scanning direction y, which is the direction normal to the plane of the drawing in FIG. 2. The guide rail 12 extends between two side frames 28 disposed on opposite sides of the print surface 24.

In FIG. 1 the print heads 14 of the two rows are shown to have a certain overlap in the sub-scanning direction y. However, it is assumed in this example that each print head 14 has a linear nozzle array (not shown) which extends in the sub-scanning direction y, and the nozzle arrays of the print heads in the two rows are positioned so as to adjoin one another in the sub-scanning direction. Thus, when the carriage 10 moves in the main scanning direction x, the print heads 14 of the two rows will be activated to print two adjoining swathes of an image without a gap or any other artefact being visible at the borderline between the two swathes.

When the carriage 10 moves from left to right in FIG. 1, the curing devices 16, 18 will be activated, and each of these curing devices will selectively treat only the surface area of the recording medium where a swath of the image has been printed with the print heads 14 in the same row. Similarly, when the carriage 10 moves in the opposite direction, the curing devices 20 and 22 will be activated and the curing device 20 will cure only the swath that has been printed with the print heads 14 of the first row and the curing device 22 will cure only the swath that has been printed with the print heads in the second row.

In the example shown, each of the two rows of print heads comprises four print heads 14 which print with inks in different colors, e.g. the colors cyan (C), magenta (M), yellow (Y) and black (K). Thus, the print heads 14 on the carriage 10 are grouped in four groups of two print heads each, each group being provided for printing in a different color. The groups are counted by an index j (j=1, . . . , 4).

As it is shown in FIG. 1, the curing devices 16 and 18 are offset relative to one another in the main scanning direction x and this offset is equal to the offset between the pairs of print heads 14 which belong to the same group. Consequently, the distances d11, d12, d13 and d14 by which the curing device 16 is spaced apart from the print heads 14 of the first row are equal to the distances d21, d22, d23 and d24 by which the curing device 18 is spaced apart from the print heads 14 of the second row, i.e.:

d11=d21
d12=d22
d13=d23
d14=d24.

Consequently, when the carriage 10 moves over the recording medium 24 with constant speed from left to right in FIG. 1, the dwell-time between the moment at which an ink droplet hits the surface of the recording medium and the moment when the ink of this droplet is cured with the curing device 16 or 18 is the same for both print heads 14 which belong to the same group and, consequently, print with the same color.

Thus, although different dwell-times apply for the different colors, the curing process for an ink droplet of any color that has been printed with a print head in the first row is indistinguishable from the curing process for an adjacent ink droplet that has been printed with the print head for the same color in the second row. In this way, no visible artefacts will be formed at the border between the swathes of the image printed with the two rows of print heads.

The same applies equivalently for the curing devices 20 and 22, when the carriage 10 moves from right to left in FIG. 1.

Further, in this example, the distance d11 between the curing device 16 and the first print head 14 in the first row (i=1, j=1) is equal to the distance between the curing device 22 and the last print head 14 in the second row (i=2, j=4). When, for example, the printer is used for printing with only two colors, e.g. M and K, the groups j=1 and j=4 may be used for the color K and the groups j=2 and j=3 may be used for M, so that the color sequence KMMK is symmetric in each row. Then, when two swathes of the image have been printed during a pass of the carriage from left to right, and then two adjoining swathes are printing during the pass of the carriage from right to left, the swath that is cured with the curing device 22 in the second pass will adjoin the swath that has been cured with the curing device 16 in the first pass. Even in that case, due to the distance relations applying for the during devices 16 and 22, like dwell-times will apply for like colors, so that no banding will occur. The same applies equivalently for the pair of curing devices 18 and 20 and their distances to the print heads.

Obviously, the printing pattern using a symmetric sequence of colors may be extended to four color printing or in general to printing with any member of colors, just by providing in each row a number of print heads that is twice the number of colors.

The invention claimed is:

1. A print head carriage assembly in a printer, comprising:

a carriage arranged to move in a main scanning direction relative to a recording medium;

a plurality of print heads mounted on the carriage and arranged to apply a curable marking material onto the recording medium; and a number of curing devices mounted on the carriage and disposed in positions relative to the print heads such that each print head is associated with at least one of the curing devices, said at least one of the curing devices being disposed to follow its associated print head in a distance in the main scanning direction so as to cure the ink that has been applied with that print head, wherein the print heads are arranged in at least two rows which extend in the main scanning direction and are staggered in a sub-scanning direction normal to the main scanning direction, and the print heads are grouped in groups of two print heads each, such that each print head in a first row has, in a second row, a counterpart print head which belongs to the same group, wherein the two print heads within each group have an offset relative to one another in the main scanning direction, wherein the curing devices comprise at least one separate curing device for each row, wherein the curing devices for the first row and the second row have an offset relative to one another in the main scanning direction, and wherein the offset between the curing devices is equal to the offset between the two print heads within each group.

2. The print head carriage assembly according to claim 1, wherein the print heads of each row are associated with two curing devices disposed at opposite ends of the row.

3. The print head carriage assembly according to claim 2, wherein the distances between a curing device at a first end of the first row and the first print heads of that row are equal to the distances between a curing device at an opposite end of a last row and the print heads in that last row.

4. The print head carriage assembly according claim 1, wherein the print heads of each row are arranged at equal spacings.

5. The print head carriage assembly according to claim 1, wherein the print heads are ink-jet print heads.

6. The print head carriage assembly according to claim 1, wherein the curing devices are radiation sources.

* * * * *